United States Patent [19]

Larsson

[11] Patent Number: 4,789,071

[45] Date of Patent: Dec. 6, 1988

[54] DISPLACEMENT AND LOCKING MEANS

[76] Inventor: Svante Larsson, Pl. 15394, S-905 90 Umeå , Sweden

[21] Appl. No.: 933,612

[22] Filed: Nov. 21, 1986

[30] Foreign Application Priority Data

Nov. 21, 1985 [SE] Sweden ..... 8505502

[51] Int. Cl.[4] ..... A47F 57/00

[52] U.S. Cl. ..... 211/208; 211/187; 211/192

[58] Field of Search ..... 211/208, 187, 192, 174, 211/190, 191; 108/144, 111

[56] References Cited

U.S. PATENT DOCUMENTS

| | | | |
|---|---|---|---|
| 3,680,711 | 8/1972 | Brucker | 211/192 X |
| 3,885,846 | 5/1975 | Chuang et al. | 211/187 X |
| 4,421,239 | 12/1983 | Vargo | 211/187 |

FOREIGN PATENT DOCUMENTS

| | | | |
|---|---|---|---|
| 1107177 | 12/1955 | France | 211/187 |
| 810693 | 3/1959 | United Kingdom | 211/187 |

*Primary Examiner*—Ramon S. Britts
*Assistant Examiner*—Sarah A. Lechok Eley
*Attorney, Agent, or Firm*—Cushman, Darby & Cushman

[57] ABSTRACT

A device in a plane supported between columns by means of hooks cooperating with the columns in a locking position for adjusting and locking the plane in different positions along the columns. In known devices of this type shifting of the plane from one position to another is troublesome and time-consuming and, further, no change of the distance between the columns is permitted. In order to make this possible the hooks (2) are connected to the plane (5) by means of links (3) articulatedly connected with the plane and pivotally connected with each their link (3) in a hinge (8), said links being pivotable, one before the other, to withdraw the respective hook (2) from locking engagement with the column (1), by which displacement of the plane can take place in one direction as well as the other, a support means (8) being associated with each hook (2) and serving in locking position as a support for the hook against the respective column (1).

4 Claims, 3 Drawing Sheets

DISPLACEMENT AND LOCKING MEANS

This invention relates to a device for releasably locking a support such as a horizontal shelf in any of several vertically-spaced-apart positions between vertical columns, and more particularly to such a device which includes hooks which releasably cooperate with the columns, the hooks being so formed that they prevent in the locking position displacement of the support in one direction but permit displacement thereof in the other direction along the columns.

Devices of this type are previously known in different embodiments but have all i.a. the drawback that the shifting of the support, from one position to another is troublesome and time-consuming, and this applies above all to shifting of the support in a direction in which the hooks in locking position prevent motion thereof. Another disadvantage of known devices of this type is that they do not allow any change of the distance between the columns carrying the support but require an exact distance between them, and consequently the known devices have also a limited use.

It is therefore the object of this invention to eliminate the above-mentioned shortcomings and to provide a device supported between columns by means of hooks cooperating with the columns in a locking position, said device being so constituted that it does not only enable a simple and quick adjustment and locking of the support in different positions but also a change of the distance between the columns carrying the support.

This object is achieved in part in that the hooks are connected to the support plane by each their link articulatedly connected to the support and are pivotally connected with their link in a hinge, said links being pivotable, one before the other, in a direction from the respective column around their hinge at the locking hook for withdrawal of the respective locking hook from locking engagement with adjacent column and consequently for making possible motion of the support in one direction as well as the other along the columns, and that a support means is associated with each locking hook that operates in locking position as a support against the respective column.

By such a device the flexibility of constructions provided with supports is improved to a large extent as the support, for example a shelf, can be adjusted and locked quickly and simply in various positions along the columns, and at the same time a change of the distance between the columns is made possible which has the effect that the device of the invention is also useful in pressing and fixing equipment where a rapid adaptation of the equipment to varying widths is desired.

Figure 1:
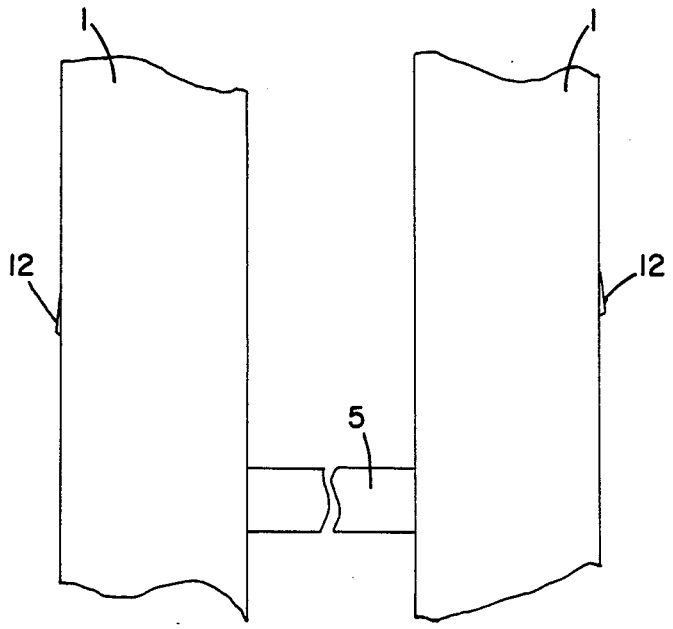
Figure 2:
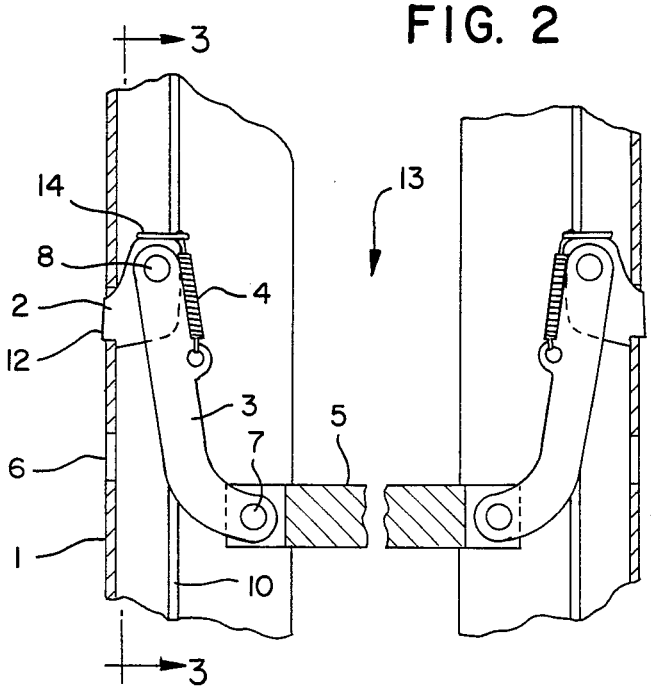
Figure 3:
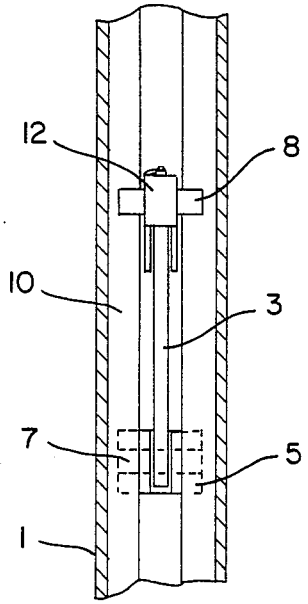
Figure 4:
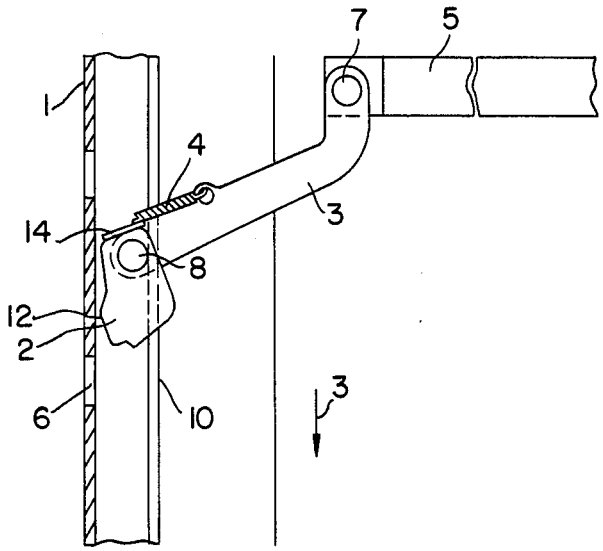
Figure 5:
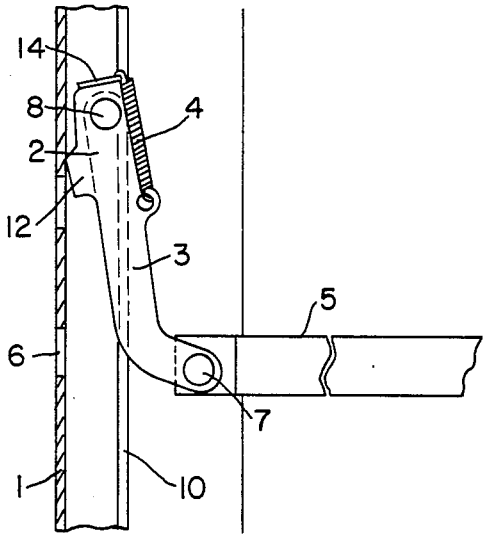

The invention is described in the following more in detail with reference to the enclosed drawings, in which FIG. 1 is a schematic lateral partial view of a support between two columns, FIG. 2 is a vertical section of the device in FIG. 1, FIG. 3 is a section substantially taken on the line III—III in FIG. 2, FIG. 4 illustrates a position of the device permitting free motion of the support in two directions, and FIG. 5 illustrates a position of the device permitting motion of the support in one direction and automatical locking of the support at motion in the other direction.

On the drawings 1 designates two columns between which a support 5 is suspended by means of the inventive device comprising hooks 2 coacting with each column, links 3 connecting these to the support 5 and springs 4 arranged between the locking hooks 2 and the links 3.

The columns 1 are profiled in such a way that the locking hooks 2, the links 3, the springs 4 and parts of the support 5 can run freely within the columns 1, and in one side of the columns 1 a number of spaced holes 6 are formed for coaction with the hooks 2 in order to lock these and consequently the support 5 against displacement in a direction relative to the columns 1 and consequently for supporting the support 5.

Each link is articulatedly attached to the support 5 by means of a hinge 7 and the link 3 is also articulatedly connected to its hook 2 by a hinge 8. This hinge can for instance consist of a stud which is arranged by its end portions (FIG. 3) projecting from the hook 2 and the link 3 to bear as a support against support edges 10, 11 especially intended for the purpose and formed within each column 1.

In locking position (FIG. 2) the hooks 2 project with their tip 12 into a hole 6 in the respective column 1 simultaneously as the studs 8 bear against the support edges 10, 11 of the respective column as support, and in order to prevent the hooks 2 from unintentionally being disengaged from the respective hole 6 a spring 4 is clamped between each hook 2 and link 3 which tends to turn the hook 2 around the hinge 8 so that at a contact pressure is achieved against the edge of the hole 6 of the column, as is apparent from FIG. 2. In each such locking position the hooks 2 and consequently the support 5 are prevented form moving in the direction marked by the arrow 13 and called locking direction in the following, but not in the opposite direction. The tip 12 of each hook is so embodied that it will automatically get out of engagement with its hole 6 upon motion of the support plane in a direction opposite to the locking direction 13 as each hook 2 is made to pivot around its hinge 8 against the action of the spring 4 which is then stretched, as is apparent from FIG. 5. Thus, in this position the support 5 can be moved freely in a direction opposite to the locking direction 13 as the hooks 2 are allowed to pass by emerging holes 6 in the columns. On the other hand, if the support plane is displaced in the locking direction 13 from the position shown in FIG. 5 the hooks 2 are made to project into the closest hole 6 by their spring 4 and accomplish locking of the support plane against further displacement in the same direction.

If a free motion of the support 5 is also desired in the locking direction 13 one link 3 is first turned about its hinge 8 which is made possible thanks to the fact that the links 3 do not bear against the respective column 1 but are pivotally movable to a certain exent within the columns 1 about the respective hinge 8 and then the other link 3 about its hinge 8, and thereafter the other link 3 about its hinge 8 until the support 5 has entered the position shown in FIG. 4. During its pivotal motion to the position shown in FIG. 4 each link 3 is made to engage with a stop means 14 formed on the hook 2 and brings then along the hook 2 which is consequently turned to a free position shown in FIG. 4 in which the hook 2 is retained as long as the links 3 and consequently the support are in the up-turned position shown in FIG. 4. Thus, in this position the hooks are prevented by the respective link 3 from being swung back by their springs 4 into locking position with a hole 6 placed in the columns, and consequently the support 5 can be moved freely between the columns 1 to any desired position. When locking of the support is desired in an intended position one link and then the other link 3 are swung together with the support to the position shown in FIG. 5 in which the hooks 2 are again free to be swung by the springs to engagement with the intended holes in the columns 1 as soon as the hooks 2 with their tip 12 have been brought onto a level with these by displacement of the support 5.

As is apparent from FIG. 2 the links 3 are spaced from the side of the respective column provided with holes in the locking position of the hooks, and in this way not only pivoting of the links 3 and the support 5 to the position shown in FIG. 4 is made possible but also a change or adjustment of the distance between the columns 1 without the function of the inventive device being risked in any respect. If the distance is increased between the columns in comparison with FIG. 2 the angle between each link 3 and the side of its column provided with holes will only increase without this having an influence on the very locking function whatsoever. Thus, a possibility of also varying the distance between the columns carrying the support 5 is provided by the device of the present invention, which has appeared to be very advantageous especially in pressing and fixing equipment where the distance between the columns often need be adapted to varying widths of the objects to be pressed or fixed.

This invention is not restricted to what has been described above and shown on the drawings, but modifications and changes are of course possible within the scope of the invention idea defined in the claims.

I claim:

1. In combination with a support having opposite edge portions disposed between two columns having a plurality of holes which lie in a common plane:

means for releasably locking said opposite edge portions to said columns, said means including each of said edge portions having a link having a first end pivoted to each said respective edge portion for rotating toward and away from each said respective column about an axis which is transverse to said common plane, each said link having a second end to which a first end of a hook is pivoted for rotation about an axis parallel to said transverse axis, said hooks having tips at their first ends which upon pivoting of the hooks in a first direction move into locking engagement with said holes and upon pivoting of the hooks in an opposite direction move out of locking engagement with said holes respective columns so as to permit adjustment of the support along said columns, said links upon pivoting movement toward their respective columns making it possible for the hooks to lockingly engage their respective columns when the distance between the columns is increased, and means limiting pivoting movement of said links away from their respective columns when said hooks are in locking engagement with each said respective columns.

2. A support as in claim 1 wherein between each hook and its link a spring is clamped for pivoting the hook into locking engagement with the respective column.

3. A support as in claim 1 wherein each said hook is provided with a stop means for its respective link for withdrawal of locking engagement with said respective column when pivoting from said column.

4. Apparatus as in claim 1 wherein the pivot connection between said hooks and said links are studs, and wherein each column includes a support edge with which the respective stud is engageable, such engagement forming said means for limiting pivoting movement of said links away from their respective columns.

* * * * *